US008622143B2

(12) United States Patent
Alvaern

(10) Patent No.: US 8,622,143 B2
(45) Date of Patent: Jan. 7, 2014

(54) DEVICE, METHOD AND USE FOR TRANSFER OF EQUIPMENT FOR A WIRELINE OPERATION IN A WELL

(75) Inventor: Jostein Alvaern, Balestrand (NO)

(73) Assignee: Quality Intervention AS (NO)

( * ) Notice: Subject to any disclaimer, the term of this patent is extended or adjusted under 35 U.S.C. 154(b) by 317 days.

(21) Appl. No.: 13/130,202

(22) PCT Filed: Nov. 19, 2009

(86) PCT No.: PCT/NO2009/000397
§ 371 (c)(1),
(2), (4) Date: Jun. 27, 2011

(87) PCT Pub. No.: WO2010/059063
PCT Pub. Date: May 27, 2010

(65) Prior Publication Data

US 2011/0253385 A1 Oct. 20, 2011

(30) Foreign Application Priority Data

Nov. 21, 2008 (NO) ..... 20084905

(51) Int. Cl.
*E21B 19/14* (2006.01)
*E21B 23/00* (2006.01)

(52) U.S. Cl.
USPC ..... 166/380; 166/75.11

(58) Field of Classification Search
USPC ..... 175/52, 85; 166/379, 380, 77.51
See application file for complete search history.

(56) References Cited

U.S. PATENT DOCUMENTS

| | | | | |
|---|---|---|---|---|
| 2,587,835 | A * | 3/1952 | Goodman | 405/10 |
| 5,503,234 | A * | 4/1996 | Clanton | 175/52 |
| 2003/0079883 | A1 | 5/2003 | McCulloch et al. | |
| 2003/0098150 | A1 | 5/2003 | Andreychuk | |
| 2006/0102356 | A1 | 5/2006 | Torgersen | |
| 2007/0119035 | A1 | 5/2007 | Moncus et al. | |

FOREIGN PATENT DOCUMENTS

| | | |
|---|---|---|
| GB | 2 418 684 A | 4/2006 |
| NO | 322006 B1 | 8/2006 |

OTHER PUBLICATIONS

Written Opinion for parent application PCT/N02009/000397, having a completion date of Feb. 9, 2010.
International Search Report for parent application PCT/N02009/000397, having a mailing date of Feb. 10, 2010.

* cited by examiner

*Primary Examiner* — William P Neuder
(74) *Attorney, Agent, or Firm* — Andrus, Sceales, Starke & Sawall, LLP

(57) ABSTRACT

Device for transfer of equipment for a wireline operation in a well connected to a drilling derrick via a top drive. The device comprises a beam structured for releasable connection to said top drive; wherein the beam is structured in a manner allowing it to extend, when in its position of use, transversely relative to a center line between the top drive and the well; wherein the beam is provided with at least one hoisting device with a lifting line for vertical movement of said equipment; wherein a support point for the lifting line is connected to the beam and is structured so as to be movable in the longitudinal direction of the beam, whereby said equipment may be moved horizontally relative to said center line; and wherein said hoisting device and support point are structured for remote-controlled operation.

15 Claims, 11 Drawing Sheets

DEVICE, METHOD AND USE FOR TRANSFER OF EQUIPMENT FOR A WIRELINE OPERATION IN A WELL

CROSS-REFERENCE TO RELATED APPLICATIONS

This application is the U.S. national stage application of International Application No. PCTNO2009/000397, filed Nov. 19, 2009, which International application was published on May 27, 2010 as International Publication No. WO 2010/059063 A1 in the English language and which application is incorporated herein by reference. The International application claims priority of Norwegian Patent Application No. 20084905, filed Nov. 21, 2008, which application is incorporated herein by reference.

AREA OF INVENTION

The present invention concerns, among other things, a device, a method and a use for transfer of equipment for a wireline operation in a well connected to a drilling derrick via a top drive. The well may be a subsea well or a land-based well. Typically, such wireline operation equipment is used in connection with various intervention operations in the well. During well intervention operations of this type, wireline (cable) or coiled tubing is used to carry miscellaneous downhole equipment down into or out of a pressurized well.

Typically, this wireline operation equipment includes a wireline blowout preventer or WL BOP, a lubricator, a grease head and miscellaneous downhole equipment, for example measuring probes.

Normally, said drilling derrick and top drive are disposed on a drilling rig, which also comprises a drill floor, drawworks and miscellaneous other, associated equipment types known per se.

If such wireline operations are to be carried out from a land-based structure or from a seabed-affixed structure offshore, for example from a seabed-affixed platform or a jack-up platform/rig, said wireline operation equipment is connected to a wellhead on surface. In this type of situation, a full well pressure will exist up to the wellhead. It is therefore necessary to connect said blowout preventer, lubricator, etc. to the wellhead before allowing downhole equipment to be introduced in the well.

Such wireline operations may also be carried out from floating vessels. Such a floating vessel may be comprised of a drilling vessel, for example a floating drilling rig or a drilling ship, provided with a drilling derrick, drill floor, drawworks, top drive, heave-compensation equipment for the top drive as well as equipment connected thereto, moon pool, etc. In this context, a riser is used to connect the floating vessel to a subsea well. This riser is assembled into a pipe string from several individual pipes.

At its upper end on surface, such a riser will typically be connected to a so-called surface flow tree disposed on, for example, a drilling vessel.

At its lower end, the riser is typically connected to a wellhead on a sea floor. Via this wellhead, the riser may be connected to, for example, a production tubing extending down to a subterranean reservoir formation, for example an oil production formation.

In this type of situation, full well pressure will exist up through the riser and possibly onwards to a surface flow tree (if mounted at the upper end of the riser). It is therefore necessary to connect said blowout preventer, lubricator, etc. to the riser, possibly to the surface flow tree, before allowing downhole equipment to be introduced in the riser and carried down into the well.

BACKGROUND OF THE INVENTION

The background of the invention is related to various problems associated with the prior art with respect to the rigging up and rigging down of wireline operation equipment for carrying out various well intervention operations in a well, including from floating vessels.

These problems relate both to aspects concerning the operation, time, cost and safety of such rigging of wireline operation equipment.

PRIOR ART AND DISADVANTAGES THEREOF

During the rigging up for a wireline operation in a well, it has been customary to use various winches and cables, including wires and chains, to lift and steer wireline operation equipment in place above a wellhead or a riser, possibly a flow tree mounted thereon, for connection or insertion therein.

During said rigging up, said blowout preventer is first lifted and steered in place on the wellhead or the riser, possibly on the flow tree, and is fixed thereto. Then the lubricator and the downhole equipment is lifted and steered in place on and within, respectively, the blowout preventer, after which the wireline operation may be initiated.

Initially, derrick-mounted and air-driven winches may be used together with associated lifting wires and steering wires for lifting and steering, respectively, the equipment in place under the top drive. A chain hoist, which is mounted under the top drive, is then used to lower the equipment on a chain and vertically down towards the wellhead or the riser, possibly the flow tree, and along a centre line thereof.

The rigging down of such wireline operation equipment takes place in the same manner, except in the opposite order.

If the wireline operation is to be carried out from a floating vessel, the wireline operation equipment must be compensated with respect to wave-related, vertical movements (heave) of the vessel. It is therefore customary to connect the riser, possibly an associated flow tree, to a heave-compensated top drive via intermediate tension elements. Typically, such tension elements are comprised of so-called lifting bails. The riser, possibly an associated flow tree as well as downhole equipment inserted therein, will thus be heave-compensated. Given that heave-compensation equipment for the top drive and the system associated with the heave-compensation equipment represents prior art, this will not be described in further detail herein.

Due to heave-movements of the vessel, the lubricator may be suspended temporarily in the top drive, for example by means of a sling connection, while the downhole equipment is lifted and inserted into the blowout preventer. At the same time, the downhole equipment is connected to a wireline (cable) for wireline operation, and the wireline extends through the lubricator, then via a disc wheel/sheave mounted underneath the top drive, and further down to a drum with associated driving gear mounted on the vessel.

The above-mentioned, vertical and horizontal movements of such wireline operation equipment are nevertheless burdened with a number of disadvantages.

Among other things, such movements require a relatively extensive operation of said lifting- and steering equipment. The movements also require many disconnections and connections of the wireline operation equipment to allow for the transfer thereof, as described above. Many of these disconnections and connections are carried out manually by virtue of drilling personnel being lifted, by means of so-called riding belts, up to the particular connection site in the drilling derrick. However, the latter work tasks are associated with significant danger in terms of safety for the drilling personnel located within the drilling derrick. Moreover, said movements as well as the disconnections and connections are relatively time-consuming, which results in increased rig time and thus increased rig costs.

In order to increase the personal safety and efficiency with respect to the rigging up and down of equipment for well intervention operations, some alternative solutions for achieving this have emerged in the last few years. Therefore, the following patent publications are mentioned in this context:

US 2006/0102356 (corresponding to NO 322006);
US 2003/0098150;
US 2003/0079883;
US 2007/0119035; and
GB 2.418.684.

Each of these publications show a frame structure for the rigging up and down of well intervention equipment, especially equipment for carrying out well intervention operations by means of coiled tubing. When in position of use, each such frame structure extends vertically, or close to vertical, above an upper end of a well. This is required for being able to connect or disconnect a blowout preventer or an injector for coiled tubing to or from a well.

Except for the frame structure shown in US 2003/0079883, all the other frame structures comprise one or more devices structured so as to allow such equipment to be moved vertically and/or horizontally within the frame structure in context of connecting or disconnecting the equipment to or from the well.

US 2006/0102356, US 2007/0119035 and GB 2.418.684 thus concern frame structures arranged for use on a drilling rig offshore.

On the other hand, US 2003/0098150 shows a collapsible frame structure for use onshore. One end of this frame structure is pivotally attached to a flatbed platform of a semi-trailer. By so doing, the structure is transportable and simultaneously allows its free end to be lifted up or down relative to the flatbed platform so as to allow easy rigging up or down during coiled tubing based intervention operations in a land-based well.

US 2003/0079883 also concerns a collapsible and transportable frame structure for use during coiled tubing based intervention operations in a land-based well. One end of the frame structure is pivotally attached to a flatbed platform of a semi-trailer, whereby its free end may be easily rigged up or down in context of such operations. However, the frame structure is telescopic in its longitudinal direction. Lifting and positioning of a blowout preventer or injector for coiled tubing therefore is carried out via telescoping of the frame structure and/or change of the frame structure's angle relative to its base.

All of the above-mentioned frame structures include an upper cross beam that joins two parallel and longitudinal elements of the structure. None of these cross beams are provided with one or more hoisting devices structured in a manner allowing them to single-handed, i.e. by virtue of its own means, and by means of remote control, carry out a complete transfer of intervention equipment from a storage place thereof and onwards to a connection point to a well, or in the opposite direction. Most of the above-mentioned publications show cross beams provided with lifting devices for partial transfer of such equipment, but not for complete transfer of the equipment. The most important part of the transfer is carried out by means of one or more other moving devices that the frame structure is provided with.

However, such frame structures are relatively bulky and heavy. This may prove problematic both in connection with a land-based well or a subsea well, but especially when such a frame structure is to be used on a floating vessel. Normally, clearly defined limitations with respect to weight and storage space for miscellaneous equipment will exist on such a vessel. For this reason it is customary to transport bulky and/or heavy equipment to/from the vessel as required. Use of such frame structures on floating vessels therefore cause a number of practical, economic and safety-related disadvantages that advantageously could be done away with.

OBJECT OF THE INVENTION

The object of the invention is to provide a technical solution that at least reduces one or more of the above-mentioned disadvantages of the prior art, particularly in connection with transfer of intervention equipment for wireline operation in a well.

A more specific object is to provide a technical solution which, relative to known solutions, is relatively simple, flexible, compact and cheap, and which is space-saving, light and safe in use.

The object is achieved by virtue of features disclosed in the following description and in the subsequent claims.

GENERAL DESCRIPTION OF HOW THE OBJECTIVE IS ACHIEVED

In a first aspect of the present invention, a device for transfer of equipment for a wireline operation in a well connected to a drilling derrick via a top drive is provided. The distinctive characteristic of the device is that it comprises a beam structured for releasable connection to said top drive;

wherein the beam is structured in a manner allowing it to extend, when in its position of use, transversely relative to a centre line between the top drive and the well;

wherein the beam is provided with at least one hoisting device with a lifting line for vertical movement of said equipment;

wherein a support point the lifting line is connected to the beam and is structured so as to be movable in the longitudinal direction of the beam, whereby said equipment may be moved horizontally relative to said centre line; and wherein said hoisting device and support point are structured for remote-controlled operation.

Relative to the above-mentioned, known frame structures, such a beam is a simple, compact, flexible and cheap structure. Insofar as the beam weighs little and occupies little space relative to said frame structures, the beam may be easily disconnected from the top drive and then be stored as a singular element at an appropriate place in vicinity of the well. This is considerably simpler and cheaper than having to transport away a large and heavy frame structure of said type. Thereby, the beam is always available when needed and may be quickly connected to the top drive.

Use of such a remote-controlled beam implies a simple and safe rigging up and rigging down of wireline operation equipment in context of well intervention operations. Having to lift drilling personnel up into the drilling derrick for disconnection and connection of such equipment, which further increases the work safety of the drilling personnel during such work tasks, is also avoided to a large extent.

Relative to the above-mentioned, known methods for rigging up and rigging down of well intervention equipment, significant rig time and thus rig costs are also saved by using the present beam.

The present beam device will now be described in further detail.

Said hoisting device may be comprised of an ordinary winch of a hydraulically driven, electrically driven or air-driven type.

The motive power, possibly also the manoeuvring force, and also control signals for the lifting device may be supplied by means of corresponding devices, connections and systems of types known per se. Such equipment may comprise motive power outlets and connections disposed in the drilling derrick and/or on the drill floor, possibly on the top drive and/or in/on a separate power unit. This equipment, however, will not be described in further detail herein.

Moreover, the beam may be structured for emergency operation of the at least one hoisting device should its ordinary motive power unexpectedly cease. As such, the beam may be provided with, or be structured to allow connection to, one or more mechanical jacking devices, ratchets or similar for manual operation, for example by means of a handle or similar. The beam may also be provided with, or be structured to allow connection to, one or more lifting winches of a hydraulically, pneumatically or electrically operated type, for example air-driven winches or chain hoists.

Typically, said lifting line is comprised of a wire or a chain.

In one embodiment, the at least one hoisting device is structured so as to be movable in the longitudinal direction of the beam. Thereby, a part or a portion of the hoisting device also forms said support point for the lifting line.

Thus, the hoisting device may be connected to a trolley structured so as to be movable along at least one running track in the longitudinal direction of the beam. Typically, such a trolley will comprise at least one wheel or pulley for movement along said running track.

For example, the trolley of the hoisting device may be provided with at least one toothed gear motor for cog wheel engagement with at least one cog railway disposed in or on the beam and in the longitudinal direction thereof. Such toothed gear motors and cog railways form ordinary components in a number of mechanical constructions. The toothed gear motor may be a hydraulically, pneumatically or electrically driven motor; cf. previous comments with respect to motive power outlets, connections, etc. for such equipment.

Alternatively, the trolley of the hoisting device may be structured for cooperation with a motorized pitch rack guide disposed in or on the beam and in the longitudinal direction thereof. Such a pitch rack guide comprises a pitch rack with an associated pinion/toothed gear and form ordinary components in a number of mechanical constructions. Rotation of the guide's pitch rack may be carried out by means of a hydraulically, pneumatically or electrically driven motor; cf. previous comments with respect to motive power outlets, connections, etc. for such equipment.

As a further alternative, the trolley of the hoisting device may be connected to at least one piston disposed in or on the beam and in the longitudinal direction thereof. Such a piston also forms an ordinary component in a number of mechanical constructions. Typically, the piston is comprised of a hydraulically driven piston in a hydraulic cylinder, but the piston may also be driven electrically or pneumatically; cf. previous comments with respect to motive power outlets, connections, etc. for such equipment.

In another embodiment, the at least one hoisting device may be fixed to the beam, whereas said support point for the lifting line is structured so as to be movable in the longitudinal direction of the beam. Thereby, the hoisting device and the support point form separate elements.

Thus, the support point may be connected to a trolley structured so as to be movable along at least one running track in the longitudinal direction of the beam. Typically, also this trolley will comprise at least one wheel or pulley for movement along said running track.

For example, the trolley may be connected to at least one toothed gear motor for cog wheel engagement with at least one cog railway disposed in or on the beam and in the longitudinal direction thereof; cf. previous comments in this respect.

Alternatively, the trolley may be structured for cooperation with a motorized pitch rack guide disposed in or on the beam and in the longitudinal direction thereof; cf. previous comments in this respect. Advantageously, the trolley, the pitch rack and the pitch rack motor may be assembled in a replaceable module, for example a replaceable cassette, which may be connected to/disconnected from the present beam.

Thereby, the module may easily be replaced upon experiencing wear or failure of components therein, or when such components must be adapted dimension-wise for transfer of other wireline operation equipment.

As a further alternative, the trolley may be connected to at least one hydraulically driven piston disposed in or on the beam and in the longitudinal direction thereof; cf. previous comments in this respect.

Furthermore, the movable support point may be comprised of a rotatable wheel or pulley to which the lifting line is movably connected. When in its position of use, the lifting line will thus extend out from the hoisting device and along a portion of the circumference of the wheel or the pulley and extend from this portion in a vertical direction downwards.

In a further embodiment, the beam may be provided with two separate hoisting devices having each a lifting line for vertical movement of said equipment.

For example, one hoisting device may be disposed for each longitudinal half of the beam for individual transfer of said equipment. As such, the two hoisting device may be structured so as to be movable along a joint path of motion in the longitudinal direction of the beam, and this joint path of motion may comprise at least one joint running track.

Alternatively, one hoisting device may be disposed for each width half of the beam for individual transfer of said equipment. As such, the two hoisting device may be structured so as to be movable along their own path of motion in the longitudinal direction of the beam, and each path of motion may comprise at least one running track. The two paths of motion will thus be parallel to each other.

The latter two embodiments, in which two hoisting devices are used, may be suitable and time-consuming when, for example, the first hoisting device is used for temporarily suspending a lubricator, which contains a cable for wireline operation, in a laterally offset position, whereas the second hoisting device is used to place a downhole tool in an associated blowout preventer. Afterwards, the first hoisting device may lower the lubricator and the cable for connection to the blowout preventer.

Said hoisting device and support point may also be structured for remote-controlled operation via at least one cabled connection. Such a cabled connection may, for example, be comprised of a hydraulic line or an electric cable.

Alternatively, said hoisting device and support point may also be structured for remote-controlled operation via at least one wireless connection, for example a radio frequency connection.

Moreover, the beam may be structured for releasable connection to and between (a) a heave-compensated top drive on a floating vessel, and (b) at least one tension member connected to an upper end of a riser connected to a subsea well. Typically, the at least one tension member is comprised of so-called lifting bails.

Due to the beam weighing little and occupying little space relative to said frame structures, the beam may easily be disconnected from the top drive and said at least one tension element, for example two parallel lifting bails. Then the beam may be stored as a singular element on board the vessel instead of having to be transported away, which is the case for said frame structures. Thereby, the beam is always available when needed and may be quickly connected between the top drive and the at least one tension element.

In a second aspect of the present invention, a system for transfer of equipment for a wireline operation in a well connected to a drilling derrick via a top drive is provided. The distinctive characteristic of the system is that it also comprises a singular beam structured for releasable connection to said top drive;

wherein the beam is structured in a manner allowing it to extend, when in its position of use, transversely relative to a centre line between the top drive and the well;

wherein the beam is provided with at least one hoisting device with a lifting line for vertical movement of said equipment;

wherein a support point for the lifting line is connected to the beam and is structured so as to be movable in the longitudinal direction of the beam, whereby said equipment may be moved horizontally relative to said centre line; and wherein said hoisting device and support point are structured for remote-controlled operation.

In one embodiment, the at least one hoisting device may be structured so as to be movable in the longitudinal direction of the beam. Thereby, a part or a portion of the hoisting device also forms said support point for the lifting line.

In another embodiment, the at least one hoisting device may be fixed to the beam, whereas said support point for the lifting line is structured so as to be movable in the longitudinal direction of the beam.

Further, said hoisting device and support point may be structured for remote-controlled operation via at least one cabled connection, for example a hydraulic line or an electric cable.

Alternatively, said hoisting device and support point may be structured for remote-controlled operation via at least one wireless connection, for example a radio frequency connection.

Moreover, the beam of the system may be structured for releasable connection to and between (a) a heave-compensated top drive on a floating vessel, and (b) at least one tension member, for example lifting bails, connected to an upper end of a riser connected to a subsea well.

The other features and advantages, which are described in context of the device according to the first aspect of the invention, also apply to the system according to this second aspect of the invention.

In a third aspect of the invention, a method for transfer of equipment for a wireline operation in a well connected to a drilling derrick via a top drive is provided. The distinctive characteristic of the method is that it comprises the following steps:

providing a singular beam with at least one hoisting device with a lifting line for vertical movement of said equipment;

structuring a support point for the lifting line so as to be movable in the longitudinal direction of the beam, the support point being connected to the beam, whereby said equipment also may be moved horizontally relative to a centre line between the top drive and the well;

structuring the beam in a manner allowing it to extend transversely relative to said centre line;

connecting the beam in a releasable manner to the top drive; and structuring said hoisting device and support point for remote-controlled operation.

In one embodiment, the at least one hoisting device is structured so as to be movable in the longitudinal direction of the beam. Thereby, a part or a portion of the hoisting device also forms said support point for the lifting line.

In another embodiment, the at least one hoisting device may be fixed to the beam, whereas said support point for the lifting line is structured so as to be movable in the longitudinal direction of the beam.

Further, said hoisting device and support point may be structured for remote-controlled operation via at least one cabled connection.

Alternatively, said hoisting device and support point may be structured for remote-controlled operation via at least one wireless connection.

Moreover, the beam may be structured for releasable connection to and between (a) a heave-compensated top drive on a floating vessel, and (b) at least one tension member, for example lifting bails, connected to an upper end of a riser connected to a subsea well.

The other features and advantages, which are described in context of the first and second aspect of the invention, also apply to the method according to this third aspect of the invention.

A fourth aspect of the invention concerns the use of a beam, which includes at least one vertically extending and horizontally extending lifting line with an associated hoisting device, for releasable connection to a top drive connected to a drilling derrick. Thereby, equipment for wireline operation in a well may be transferred for connection to the well.

According to this use, the beam may be releasable connected to and between (a) a heave-compensated top drive on a floating vessel, and (b) at least one tension member, for example lifting bails, connected to an upper end of a riser connected to a subsea well.

Hereinafter, non-limiting exemplary embodiments of the invention will be shown.

SHORT DESCRIPTION OF THE FIGURES OF THE EXEMPLARY EMBODIMENTS

Figure 1:
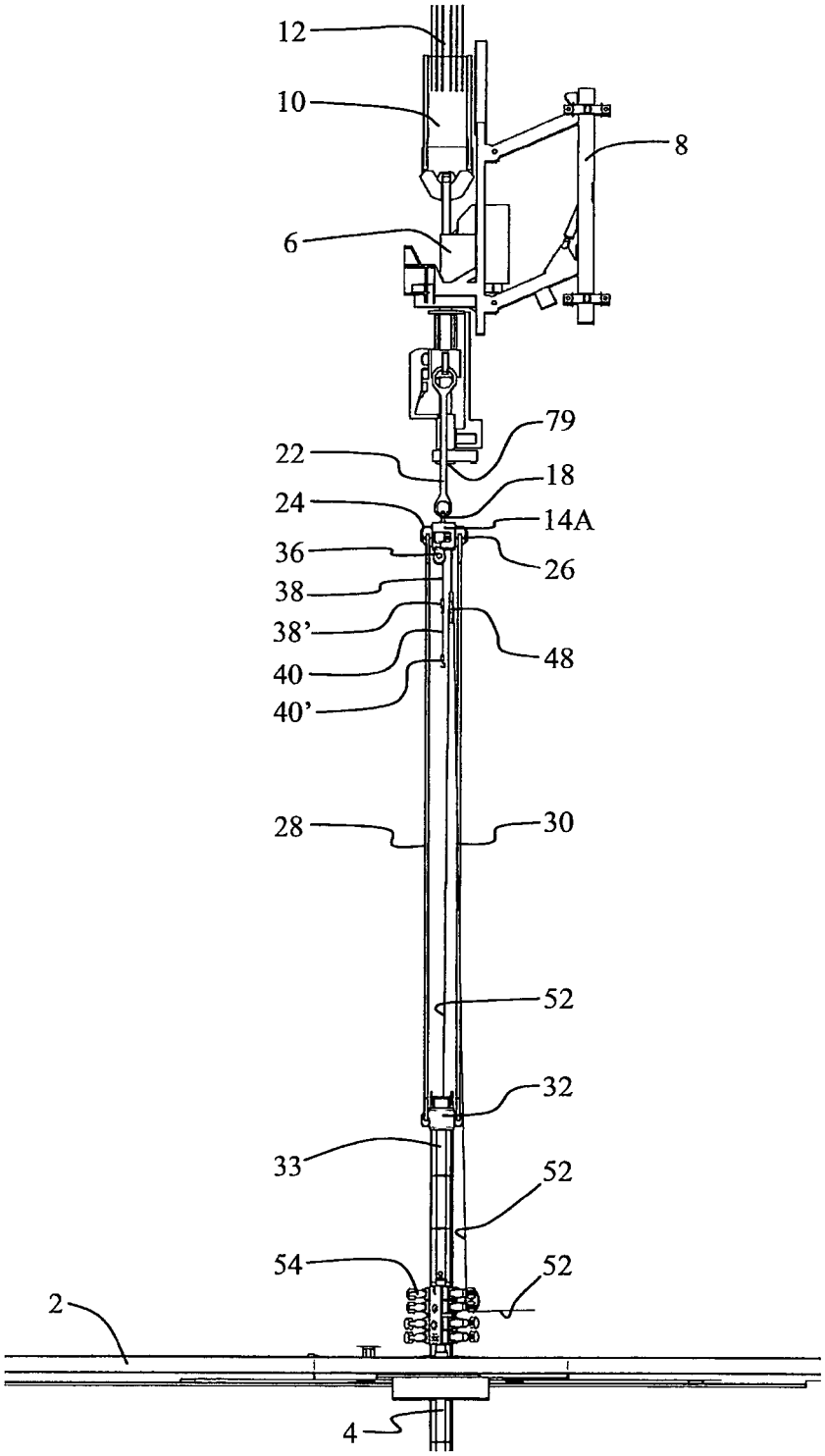
FIG. 1 shows a side elevation of miscellaneous equipment, including a beam according to the first embodiment of the invention, disposed above a drill floor on a floating drilling vessel during rigging up of equipment for wireline operation in a subsea well.

FIGS. 11-15 show principal drawings of a third embodiment of a beam having a remote-controlled winch fixed to the beam, whereas a remote-controlled support point for a lifting line is structured so as to be movable in the longitudinal direction of the beam; and FIGS. 16-20 show a fourth embodiment of a beam provided with two separate, remote-controlled winches fixed to the beam, whereas two separate, remote-controlled and winch-associated support points for a lifting line each are structured so as to be movable in the longitudinal direction of the beam.

In order to facilitate the understanding of the invention, some of the figures are depicted in a simplified manner and show only the most essential elements of the present beam and associated equipment. The shape, relative dimensions and mutual positions of the elements may be somewhat distorted. Hereinafter, identical, equivalent or corresponding details in the figures will be given substantially the same reference numerals.

SPECIFIC DESCRIPTION OF THE EXEMPLARY EMBODIMENTS

FIGS. 1-5 show an assembly of miscellaneous equipment disposed within a drilling derrick (not shown) and above a drill floor 2 on a floating vessel (not shown). In this context, this equipment is used for wireline operation in a subsea well (not shown) connected to the vessel via a riser 4 extending partway above the drill floor 2. The riser 4 extends from the vessel and down to a wellhead (not shown) placed on a sea floor.

Said equipment comprises, among other things, a top drive 6 which is fixed to a heave-compensated support frame 8, and which may be raised or lowered by means of a heave-compensated drawworks comprising, among other things, a travelling block 10 and associated wires 12. Heave-compensation of this type constitutes prior art and will not be described in further detail herein.

The figures also show a first embodiment of a beam 14A according to the invention disposed in a releasable manner, and in its position of use, between the top drive 6 and the drill floor 2. At its upper side, the beam 14A is provided with two first lifting lugs 16, 18, each of which is releasably connected to a lifting bail 20, 22. These lifting bails 20, 22 extend in a parallel manner up to the top drive 6 and are releasably connected to lifting lugs thereon. Midway on each of its longitudinal sides, the beam 14A is also provided with a second lifting lug 24, 26, which is releasably connected to a respective lifting bail 28, 30. These bails 28, 30 extend in a parallel manner down towards the drill floor 2 and are releasably connected to a connection sleeve 32 attached around an upper end 33 of the riser 4. In this manner, the beam 14A is structured for releasable connection to and between the top drive 6 and the lifting bails 28, 30. By so doing, the beam 14A is also structured in a manner allowing it to extend transversely relative to a centre line for the upper end 33 of the riser 4.

The weight of the riser 4 and the associated equipment is transferred to the heave-compensated top drive 6 and drawworks via said connection sleeve 32, whereby the riser 4 is held in constant tension.

FIGS. 1-5 also show the beam 14A provided with two separate, remote-controlled, hydraulic winches 34, 36 having each a respective lifting wire 38, 40 with a lifting hook 38', 40' for vertical movement of miscellaneous equipment for wireline operation in the subsea well. In this embodiment, each winch 34, 36 is also structured so as to be movable along a respective longitudinal half of the beam 14A for individual, remote-controlled transfer along a joint path of motion 42 in the longitudinal direction of the beam. By so doing, each winch 34, 36 may be moved horizontally relative to said centre line when the beam 14A is in its position of use. In order to be able to carry out such an individual transfer, each winch 34, 36 is connected to a manoeuvring device in the form of a hydraulically driven piston in a hydraulic cylinder (not shown) incorporated into the beam 14A. Hydraulic motive power and control signals for the winches 34, 36 and their pistons is supplied from corresponding devices, connections and systems of types known per se, and which will not be described in further detail herein. The figures only show the respective hydraulic couplings emerging from the winches 34, 36. Moreover, each movable winch 34, 36 forms a support point for the respective lifting wire 38, 40.

Further, the figures show a disc wheel 48 connected to the lower side of the beam 14 via a wire 50. A wireline 52 for insertion of equipment in the well is carried over the disc wheel 48 and onwards down to a drum with associated driving gear (not shown) on the drilling rig.

Figure 2:
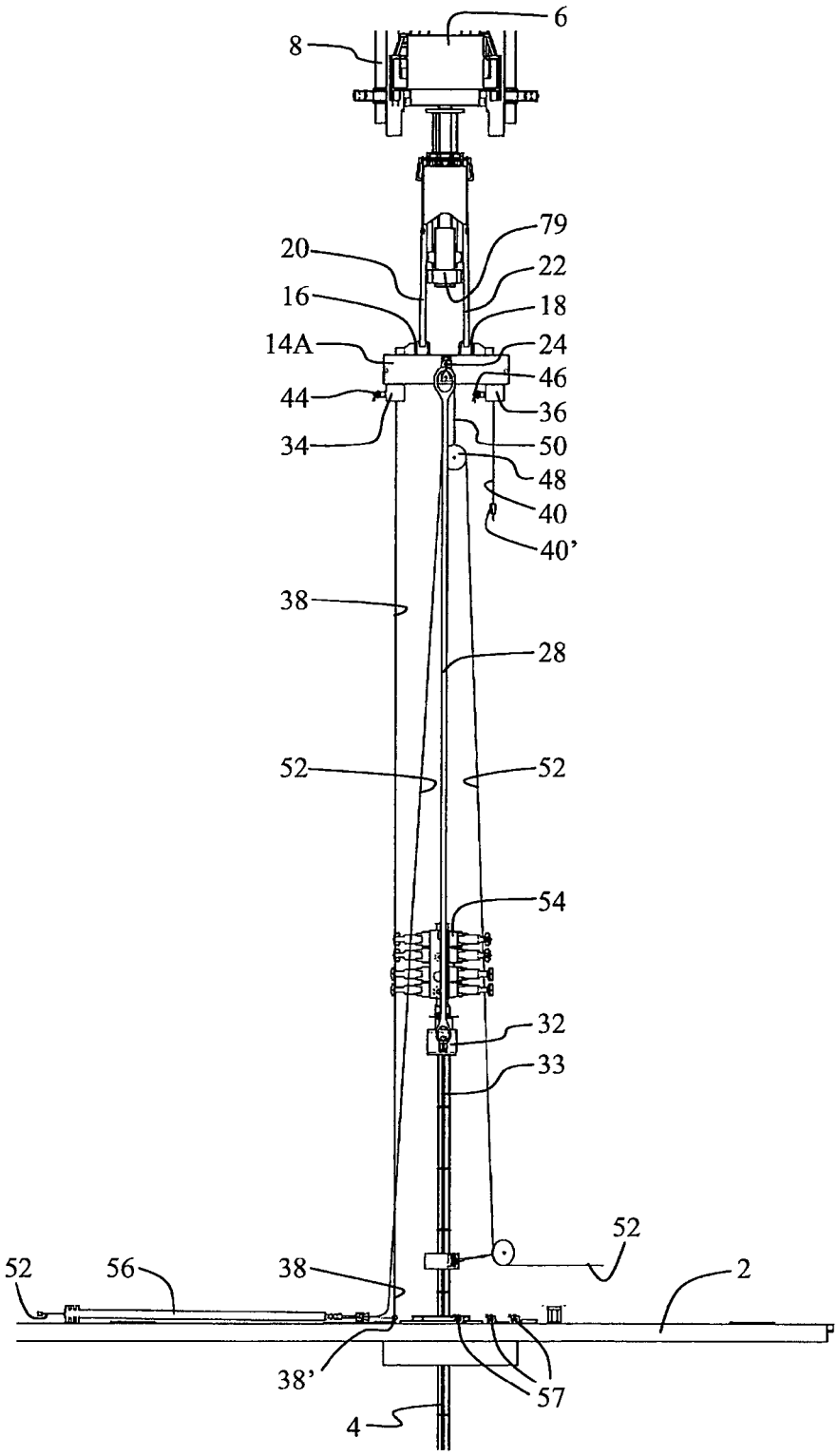
FIG. 2 shows a front elevation of the equipment shown in FIG. 1.
Figure 3:
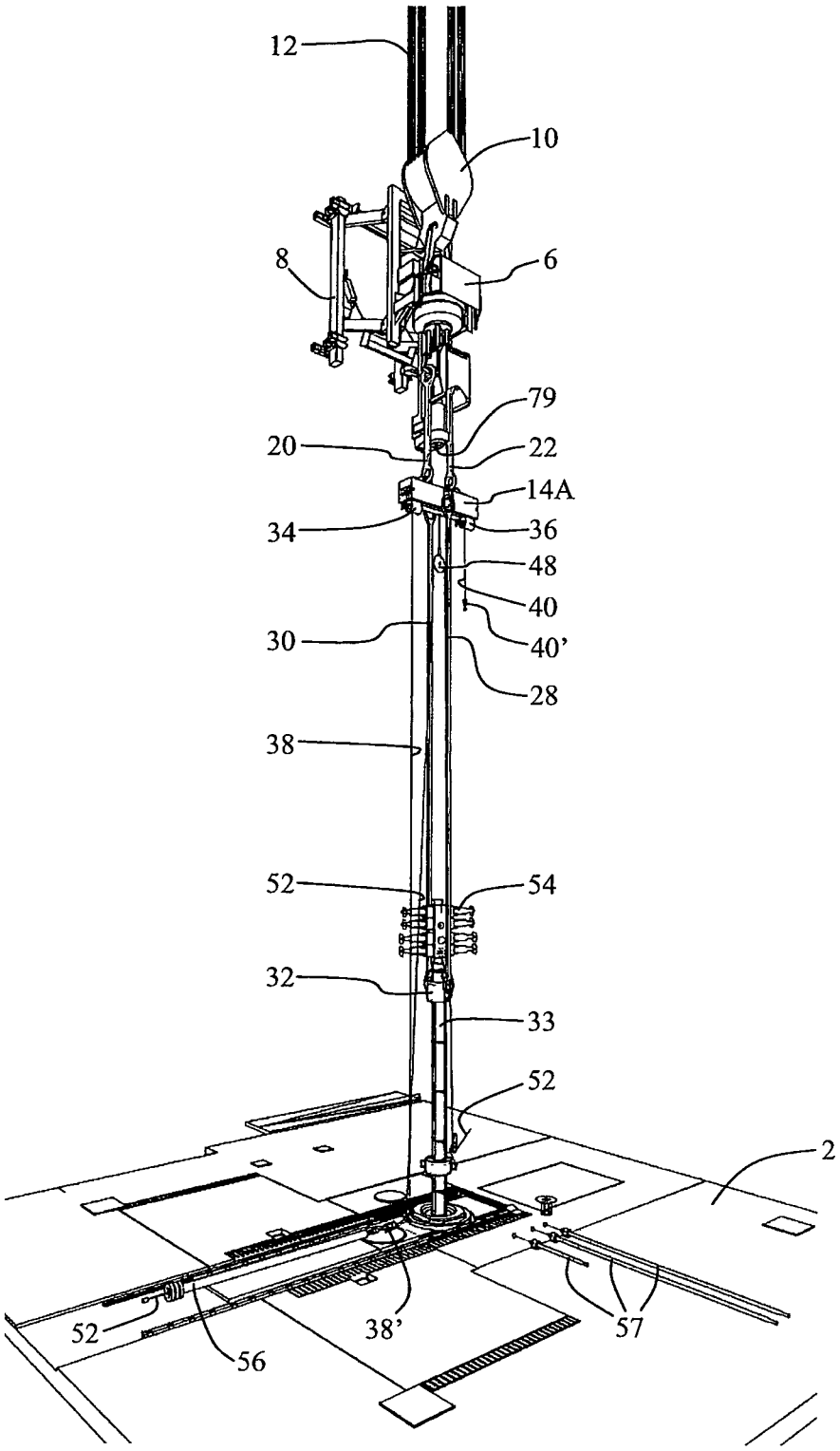
FIG. 3 shows a side perspective of the equipment shown in FIGS. 1 and 2.
Figure 4:
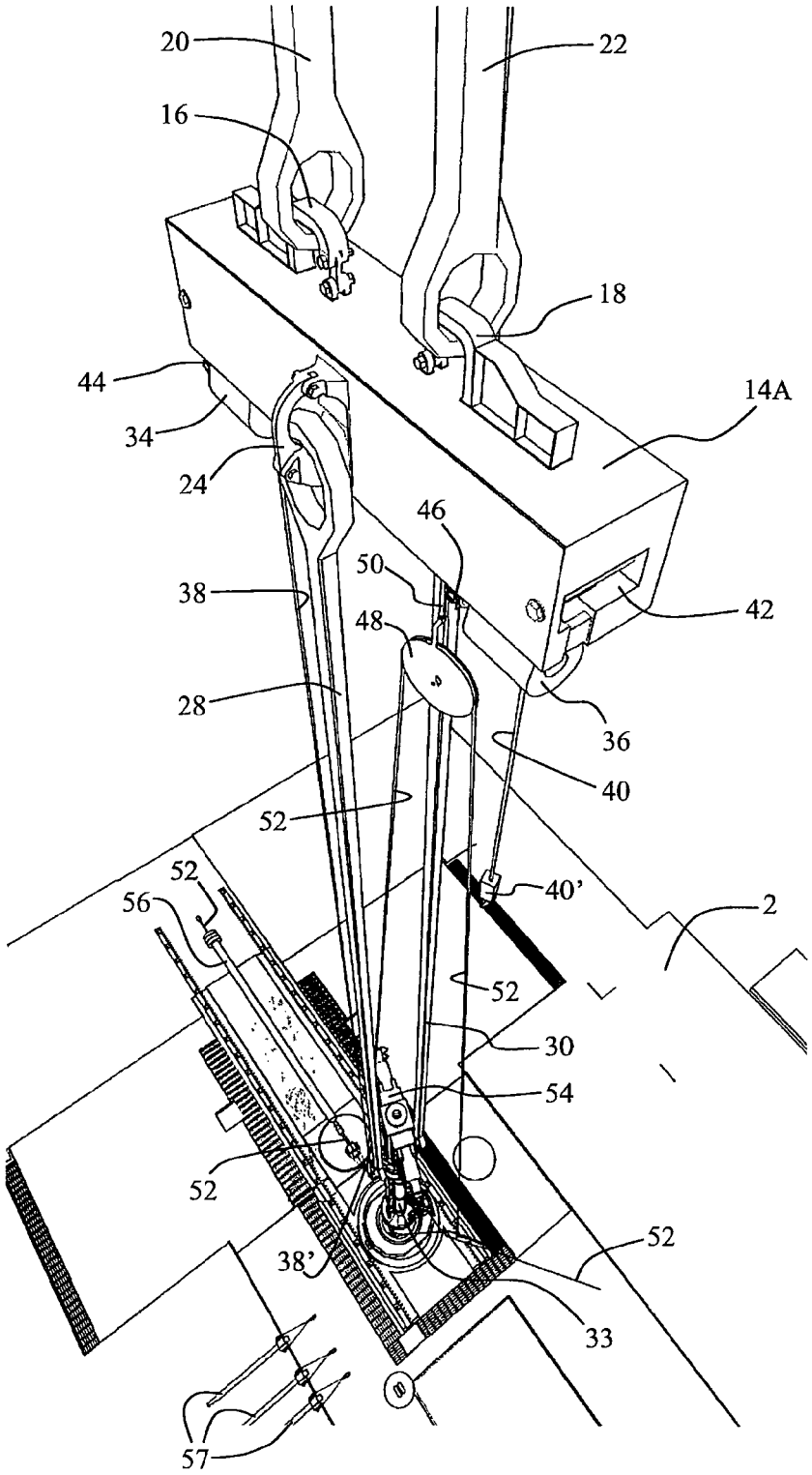
FIG. 4 shows a bird's-eye view of the equipment shown in FIGS. 1, 2 and 3.
Figure 5:
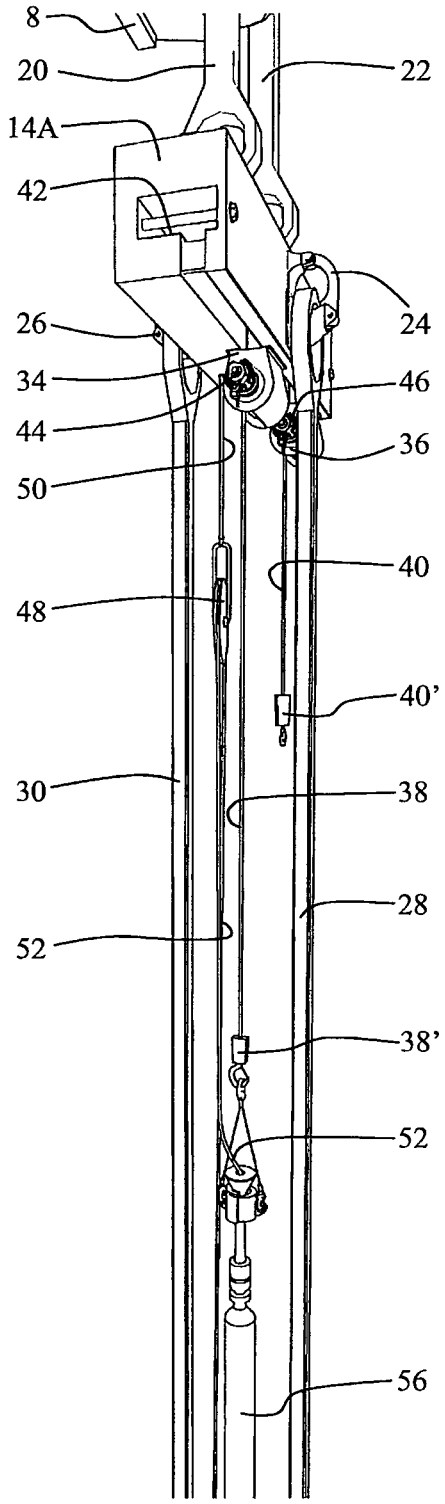
FIG. 5 is a front perspective, at a larger scale, of the beam according to the invention, among other things.
Figure 6:
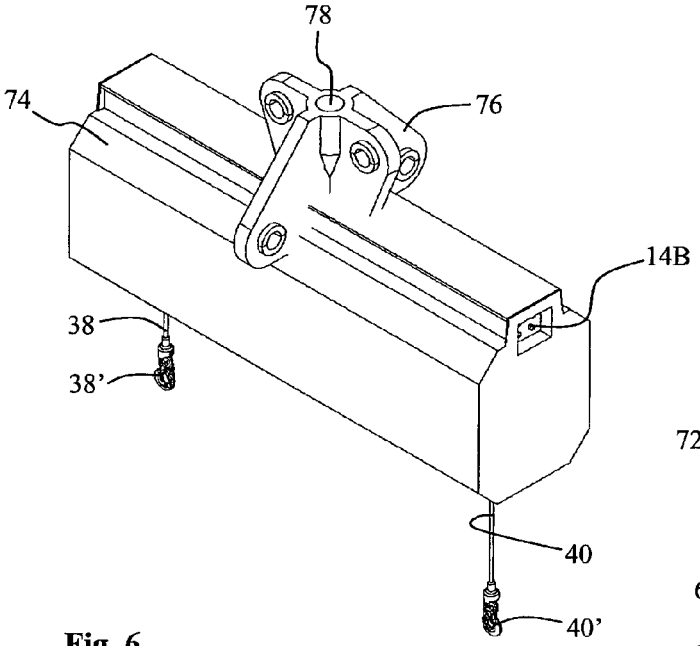
FIGS. 6-10 show a second embodiment of a beam having two separate, remote-controlled winches structured so as to be movable in the longitudinal direction of the beam.
Figure 8:
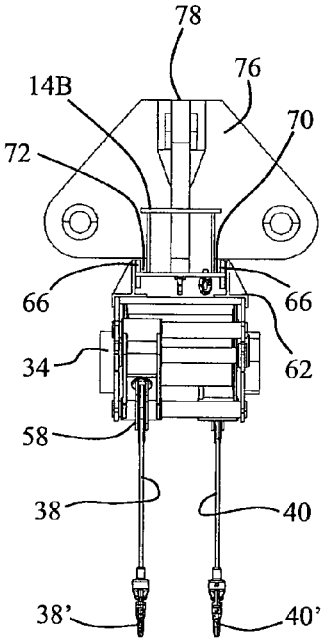
Figure 7:
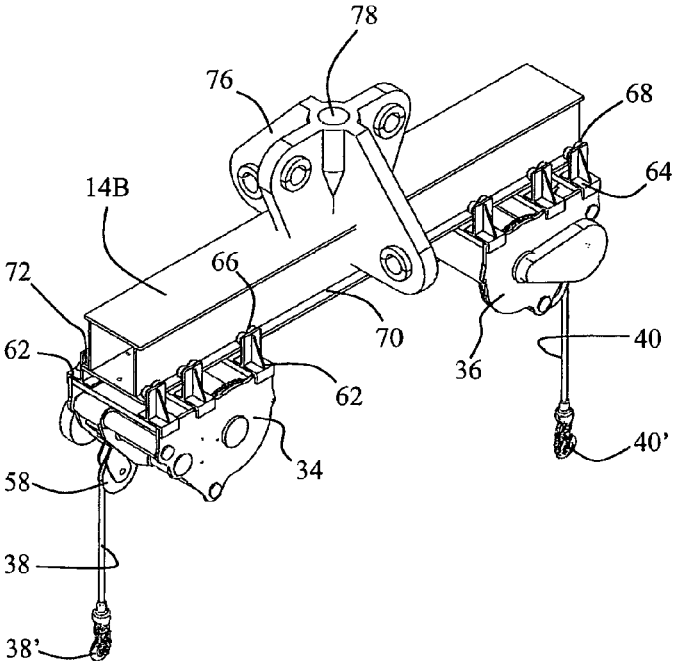

FIGS. 1-5 also depict a certain transfer sequence of miscellaneous equipment for wireline operation. As such, FIG. 1 shows a blowout preventer 54 for wireline operations placed on the drill floor 2 and beside the upper end of the riser 4. FIGS. 2-4 show various perspectives of the blowout preventer 54 after having been lifted, steered in place and rigidly mounted on top of the upper end of the riser 4 by means of the beam 14A and one of its winches 34, 36. FIGS. 2-4 also show the winch 34 moved to one end of the beam 14A whilst the lifting wire 38 thereof, via suitable connection equipment, is being releasably connected to a lengthy lubricator 56 lying on the drill floor 2 with said wireline 52 inserted through it. FIG. 5, however, shows the lubricator 56 with the wireline 52 upon having lifted, by means of the movable winch 34 and the lifting wire 38, this equipment up underneath the beam 14A and steered it in towards the centre line of the riser 4. The next step (not shown) is to lower the equipment down onto the blowout preventer 54 for rigid mounting thereto. Via suitable connection equipment, the other, movable winch 36 with its lifting wire 40 may, for example, be used to lift and move a three-part downhole tool 57 (cf. FIGS. 2-4) into the blowout preventer 54 whilst the lubricator 56 is temporarily suspended in the lifting wire 38 of the other winch 34.

Referring to FIGS. 6-10, a second embodiment of a beam 14B according to the invention will now be shown.

Also in this second embodiment, the beam 14B is provided with two separate, remote-controlled, hydraulic winches 34, 36, each having a respective lifting wire 38, 40 and a respective lifting hook 38', 40'. Each lifting wire 38, 40 emerges from its winch 34, 36 via a support point which, in this embodiment, assumes the form of a respective wire pulley 58, 60, which forms a part or a portion of each winch 34, 36. Such a wire pulley 58, 60, however, is not a prerequisite. In other embodiments, the lifting wire 38, 40 may emerge directly from the wire drum of the winch 34, 36, whereby the wire drum forms said support point for the lifting wire 38, 40.

Each winch 34, 36 is structured so as to be movable along a respective longitudinal half of the beam 14B for individual, remote-controlled transfer along a joint path of motion in the longitudinal direction of the beam. Each winch 34, 36 may thus be moved horizontally when the beam 14B is in its position of use. For such individual transfer, each winch 34, 36 is connected to a respective trolley 62, 64 comprising parallel sets of wheels 66, 68 for movement along parallel running tracks 70, 72. These running tracks 70, 72 form said joint path of motion for the winches 34, 36. For remote-controlled propulsion along this path of motion, each winch 34, 36 is provided with a toothed gear motor (not shown) for cog wheel engagement with a corresponding cog railway (not shown) disposed underneath the beam 14B in the longitudinal direction thereof.

The beam 14B, including the winches 34, 36 etc., are incorporated in a protective beam housing 74. At the upper side thereof, the beam housing 74 is provided with a cross-shaped connector 76 with a centred, female thread portion 78 for releasable connection to a mail thread portion at the end of a connecting pipe (not shown). This connecting pipe may be connected to a pipe coupling 79 at the lower side of said top drive 6. Such a connecting pipe and connector 76 replace the connecting bails 20, 22 and the two first lifting lugs 16, 18, respectively, shown in the embodiment according to FIGS. 1-5.

Figure 9:
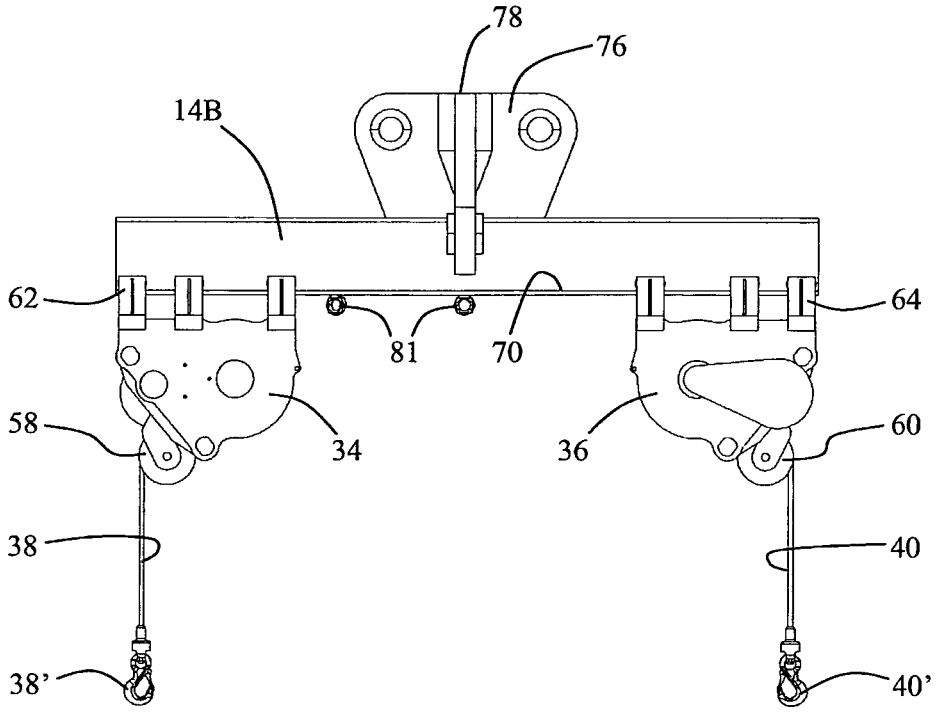
Figure 10:
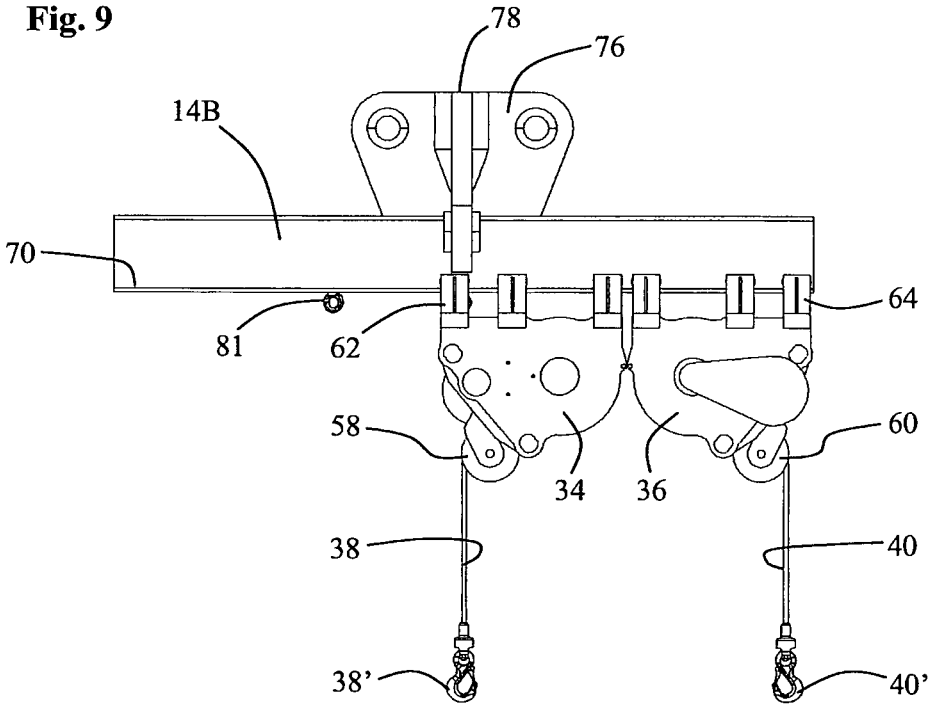

Furthermore, FIG. 9 shows the two winches 34, 36 disposed each at a respective end of the beam 14B. FIG. 10, however, shows the winch 34 after having been moved along the beam 14B to a position in which the lifting wire 38 is located approximately midway on the beam 14B. FIGS. 9 and 10 also show fasteners in the form of eye bolts 81 releasably attached within corresponding holes on the lower side of the beam 14B. Such eye bolts 81 may, for example, be used to connect a wireline disc wheel 48 to the lower side of the beam 14B via a wire 50, as shown in FIGS. 1-5. If potentially needed, the eye bolts 81 may also be used for suspension of, for example, an air-driven winch or a chain hoist.

Referring to FIGS. 11-15, a third embodiment of a beam 14C according to the invention will now be shown. The figures are of principal nature and show only the most essential elements of the embodiment.

In this third embodiment, the beam 14C is provided with one remote-controlled, hydraulic winch 34 fixed at one end of the beam 14C. A lifting wire 38 emerges from the winch 34 and is first carried around half the circumference of a non-movable disc wheel 80 which, via a mounting bracket 82, is fixed at the opposite side of the beam 14C. The lifting wire 38 then extends in the direction of the winch 34 and around half the circumference of a movable hook-height adjustment disc wheel 84 and further around a quarter of the circumference of a movable support disc wheel 86 disposed closer to the non-movable disc wheel 80. By so doing, the lifting wire 38 will extend vertically from the support disc wheel 86 when the beam 14 is in its position of use. Thus, the support disc wheel 86 forms a movable support point for the lifting wire 38. Furthermore, the path of the lifting wire 38 from the non-movable disc wheel 80 and onwards to the movable support disc wheel 86 is indicated with a dotted line in FIGS. 11 and 13-15.

Figure 11:
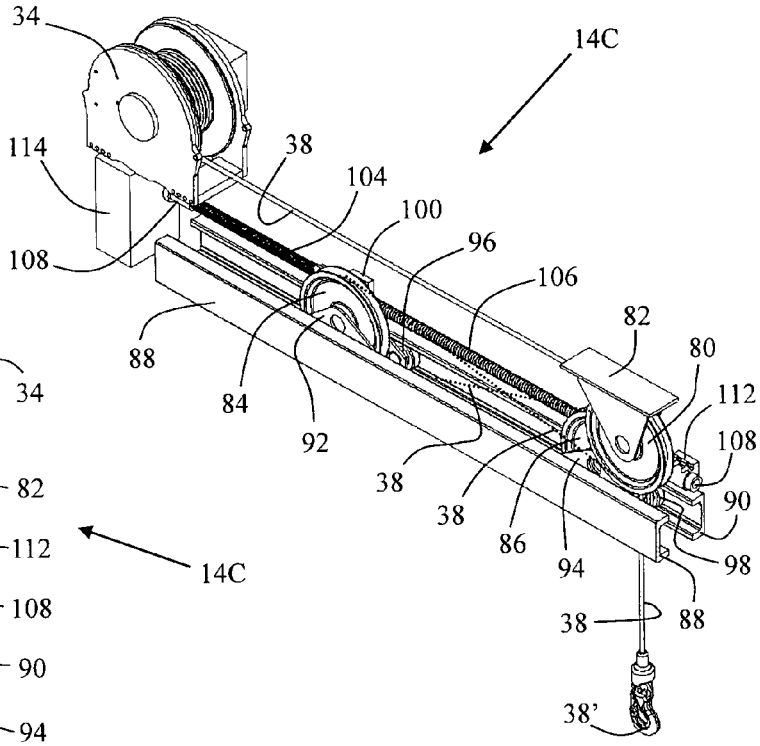
Figure 12:
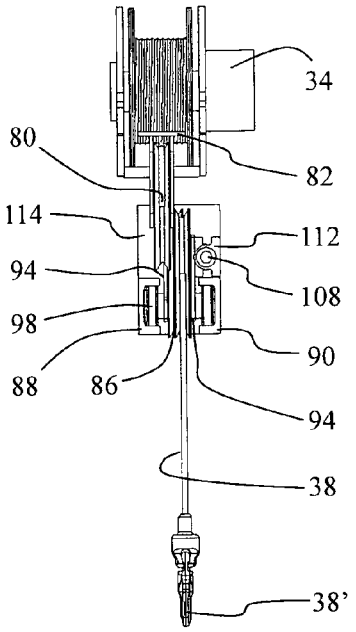
Figure 13:
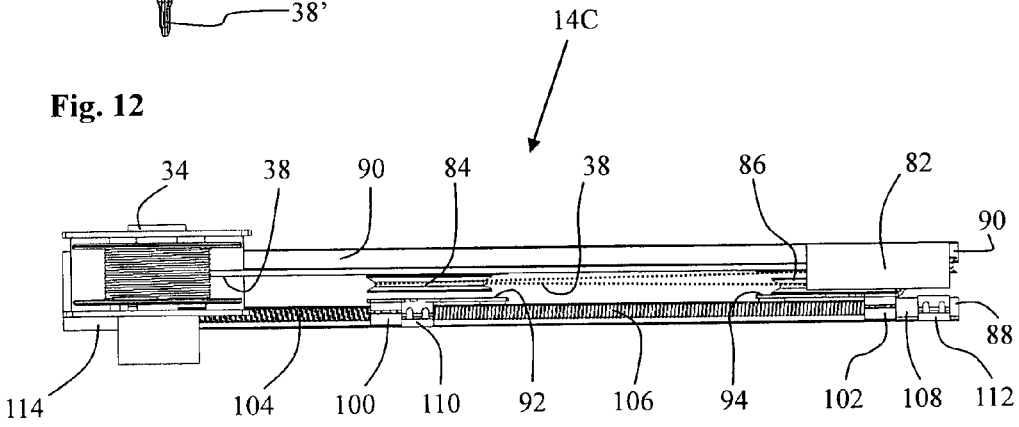

Both the hook-height adjustment disc wheel 84 and the support disc wheel 86 are structured so as to be movable in the longitudinal direction of the beam 14C and along a joint path of motion comprising two parallel U-rails 88, 90 having openings facing each other, as shown in FIGS. 11 and 12.

Further, the hook-height adjustment disc wheel 84 and the support disc wheel 86 are connected to a respective trolley 92, 94 comprising parallel sets of wheels 96, 98 for movement within and along respective U-rails 88, 90, as shown in FIG. 12.

The trolleys 92, 94 are structured for cooperation with a motorized pitch rack guide connected to the beam 14C. Each trolley 92, 94 is fixedly connected to a corresponding nut device 100, 102, for example a ball nut, disposed around a corresponding thread portion 104, 106 of a pitch rack 108. This pitch rack 108 is arranged in the longitudinal direction of the beam 14C and is rotatably connected to two support bearings 110, 112 attached to the beam 14C. For rotation the pitch rack 108 is connected to a remote-controlled, hydraulic motor 114 disposed at the one end of the beam 14C. Such a motorized pitch rack guide 102, 108 may also be used for propulsion of the winches 34, 36 used in context of the beams 14A and 14B according to the first and second embodiment of the invention.

Figure 14:
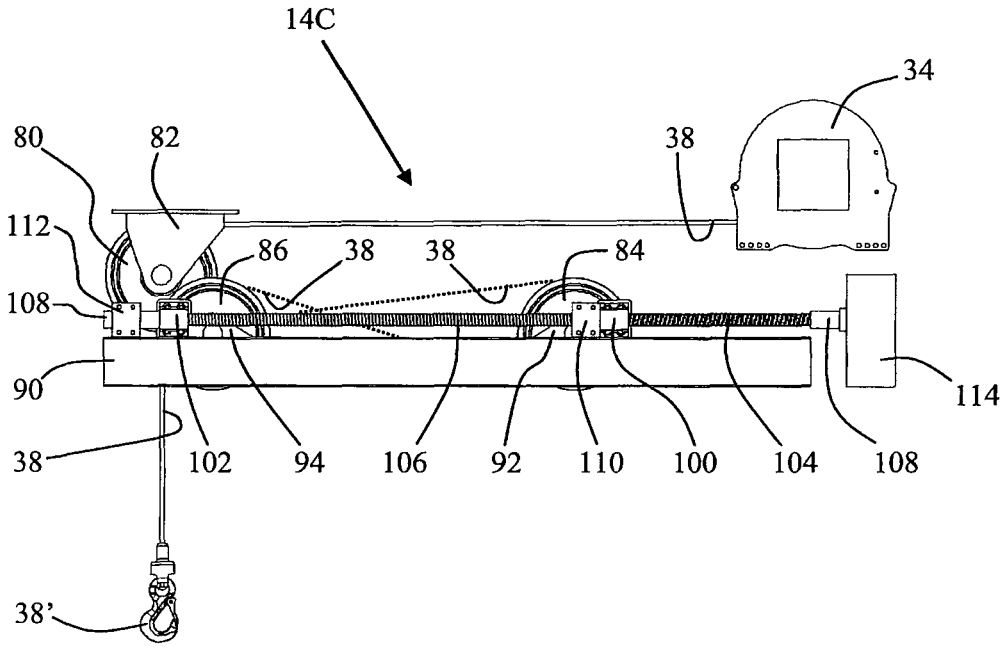
Figure 15:
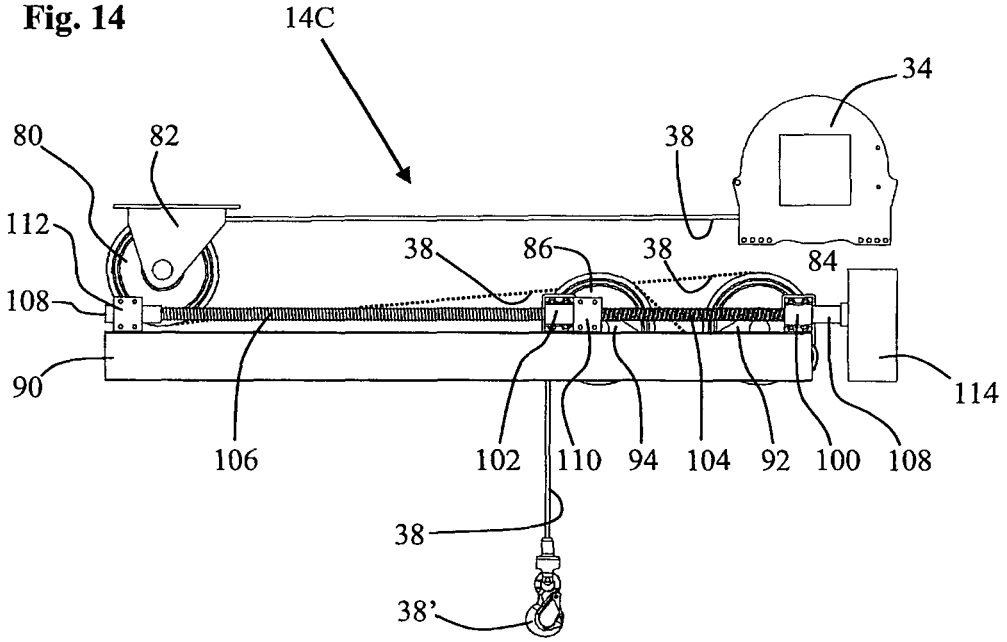
Figure 16:
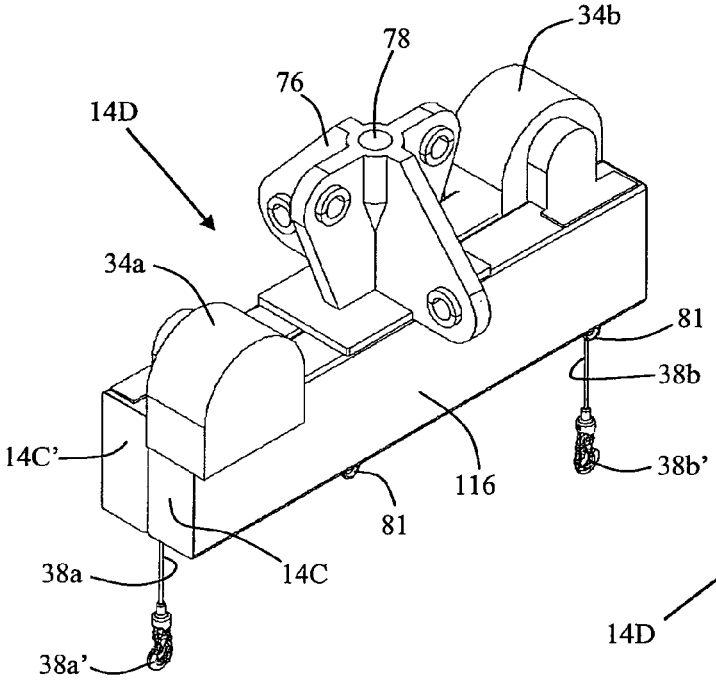
Figure 17:
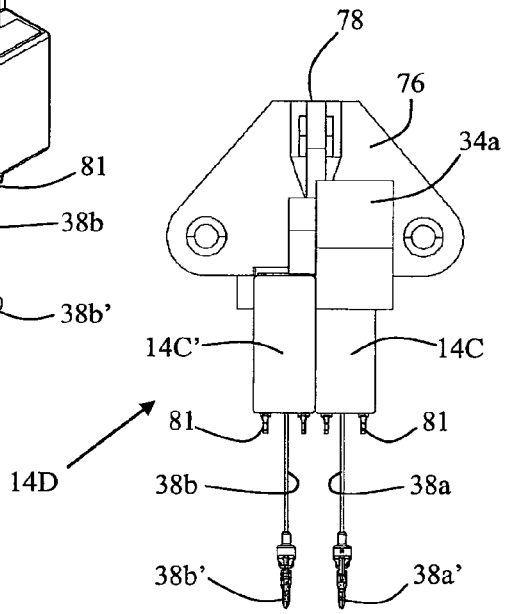
Figure 18:
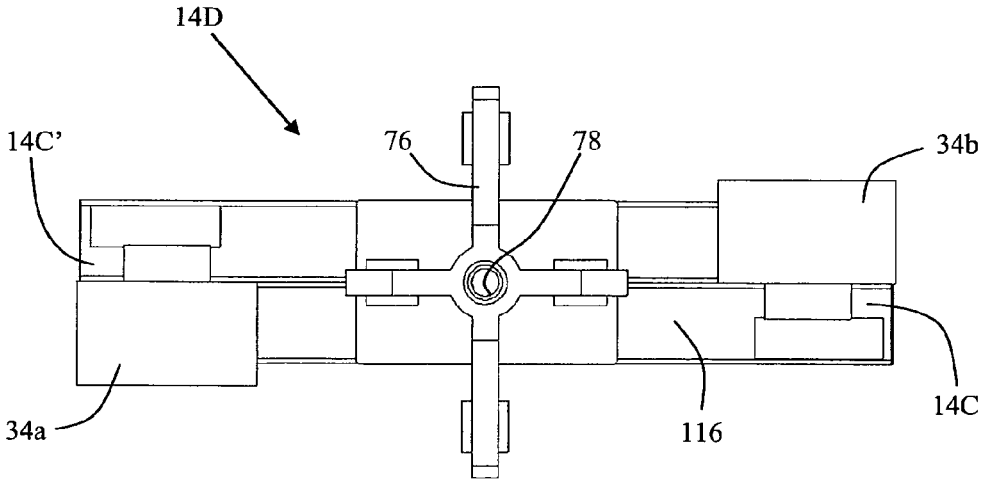
Figure 19:
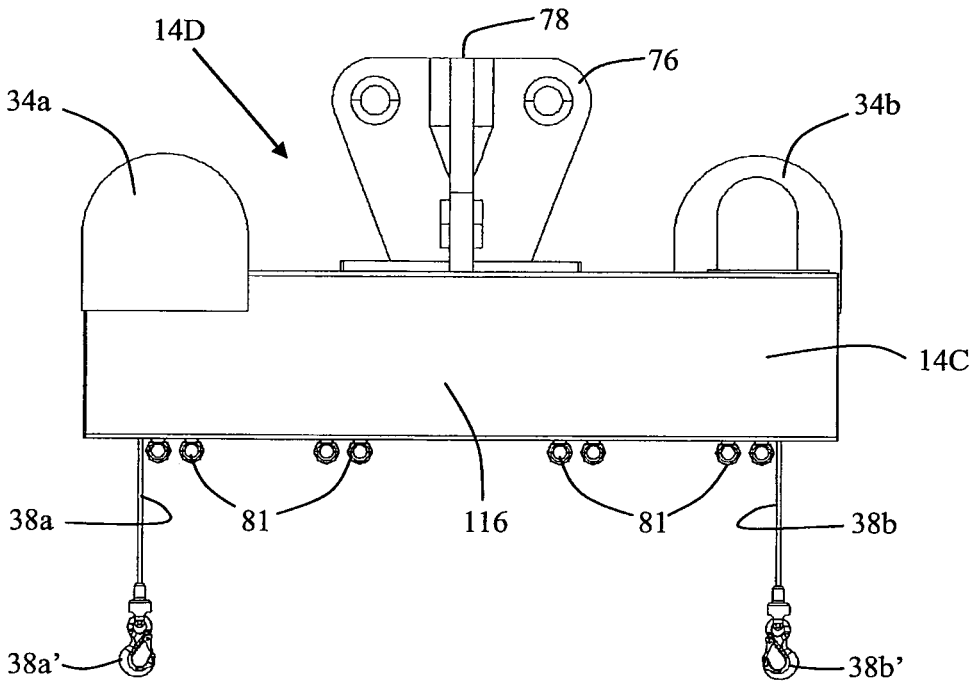
Figure 20:
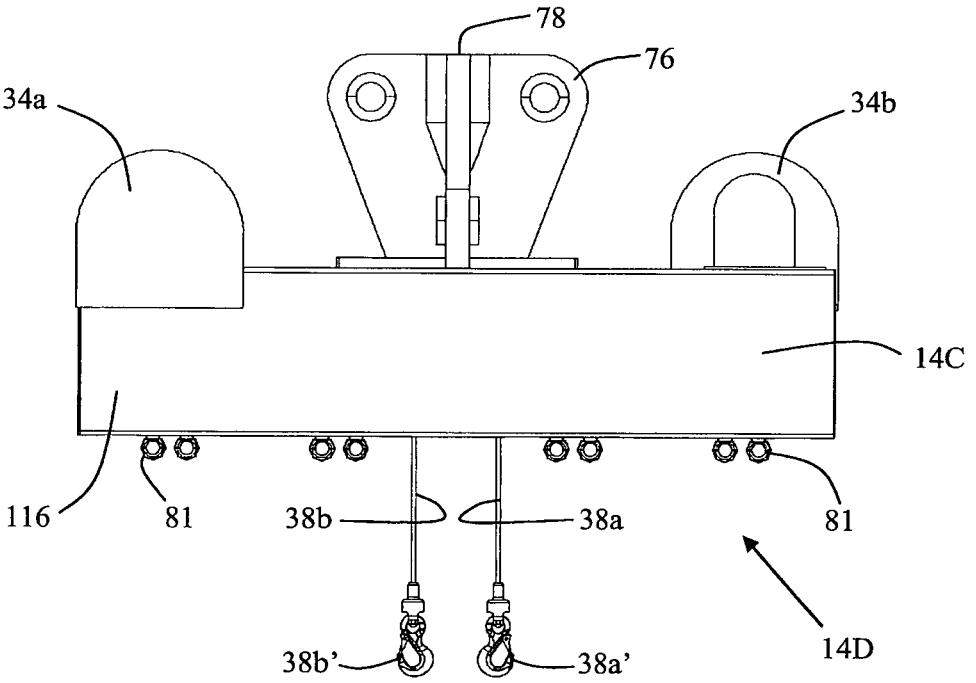

The thread portions 104, 106 are threaded in the same direction, whereby the trolleys 92, 94 will move in the same direction upon rotation of the pitch rack 108. The thread portion 104, however, is finely threaded, whereas the thread portion 106 is coarsely threaded having twice the thread pitch relative to that of the finely threaded portion 104. When the pitch rack 108 is rotated, this construction brings about the advantageous result that the trolley 92 (and thus the hook-height adjustment disc wheel 84) will move at half the speed along the pitch rack 108 as compared to the speed of the trolley 94 (and thus the support disc wheel 86 and its vertically extending lifting wire 38) along the pitch rack 108. This causes the lifting hook 38' to be held at a constant distance from the beam 14C when the trolleys 92, 94 are being moved horizontally, and without simultaneously carrying out any feeding of lifting wire 38 from or to the winch 34. Such movement of the trolleys 92, 94 at a constant hook-height is shown in FIGS. 14 and 15.

In this context, it is obviously possible to omit the hook-height adjustment disc wheel 84 and associated components and to use a pitch rack having only one uniformly threaded thread portion. This, however, will bring about the effect that the lifting hook 38' will change its distance from the beam 14C when the trolleys 92, 94 are being moved horizontally without simultaneously carrying out feeding of lifting wire 38 from or to the winch 34.

Furthermore, the U-rails 88, 90, the trolleys 92, 94, the hook-height adjustment disc wheel 84, the support disc wheel 86, the pitch rack 108, the nut devices 100, 102, the support bearings 110, 112 and the hydraulic motor 114 may advantageously be assembled in a joint module, for example a replaceable cassette, for simple and quick replacement, if required.

Referring to FIGS. 16-20, a fourth embodiment of a beam 14D according to the invention will now be shown.

In this fourth embodiment, two beams 14C and 14C' according to the preceding, third embodiment are assembled in parallel, but oppositely directed, within a joint beam 14D. Each of the two beams 14C, 14C' contains the same components and have the same mode of operation as described in context of the third embodiment according to the invention. As such, each beam 14C, 14C' will include, among other things, a respective, remote-controlled, hydraulic winch 34*a*, 34*b* with an associated lifting wire 38*a*, 38*b* and lifting hook 38*a*', 38*b*', a movable hook-height adjustment disc wheel, a support disc wheel as well as associated components (not shown in FIGS. 16-20). The winches 34*a*, 34*b* are disposed diagonally opposite each other at their own end of the combined beam 14D.

The beams 14C, 14C' with associated components are incorporated in a protective beam housing 116; this in resemblance to the beam 14B according to the above-mentioned, second embodiment of the invention. Correspondingly, the upper side of the beam housing 116 is provided with a cross-shaped connector 76 with a centred, female thread portion 78 for releasable connection to a connecting pipe (not shown), which may be connected to the lower side of said top drive 6.

Also FIGS. 16, 17, 19 and 20 show eye bolts 81 releasably attached to the lower side of the beam 14D for possible suspension of, for example, a wireline disc wheel 48, an air-driven winch or a chain hoist, as shown in FIGS. 1-5.

The invention claimed is:

1. A device for transfer of equipment for a wireline operation in a well connected to a drilling derrick via a top drive, wherein the device comprises a beam structured for releasable connection to said top drive;

wherein the beam has a longitudinal direction and is structured in a manner allowing the beam to extend, when in a position of use of the beam, transversely relative to a center line between the top drive and the well; and wherein the beam is provided with at least one hoisting device with a lifting line for vertical movement of said equipment, wherein a support point for the lifting line is connected to the beam and is structured so as to be movable in the longitudinal direction of the beam, whereby said equipment may be moved horizontally relative to said center line; and wherein said hoisting device and support point are structured for remote-controlled operation.

2. The device according to claim 1, wherein the at least one hoisting device is structured so as to be movable in the longitudinal direction of the beam, whereby a part of the hoisting, device forms said support point for the lifting line.

3. The device according to claim 2, wherein the hoisting device is connected to a trolley structured so as to be movable along at least one running track in the longitudinal direction of the beam.

4. The device according to claim 3, wherein the trolley of the hoisting device is provided with at least one toothed gear motor for cog wheel engagement with at least one cog railway disposed in or on the beam and in the longitudinal direction thereof.

5. The device according to claim 3, wherein the trolley of the hoisting device is structured for cooperation with a motorized pitch rack guide disposed in or on the beam and in the longitudinal direction thereof.

6. The device according to claim 3, wherein the trolley of the hoisting device is connected to at least one piston disposed in or on the beam and in the longitudinal direction thereof.

7. The device according to chum 1, wherein the at least one hoisting device is fixed to the beam, whereas said support point for the lifting line is structured so as to be movable in the longitudinal direction of the beam.

8. The device according to claim 7, wherein the support point is connected to a trolley structured so as to be movable along at least one running track in the longitudinal direction of the beam.

9. The device according to claim 8, wherein the trolley is connected to at least one toothed gear motor for cog wheel engagement with at least one cog railway disposed in or on the beam and in the longitudinal direction thereof.

10. The device according to claim 8, wherein the trolley is structured for cooperation with a motorized pitch rack guide disposed in or on the beam and in the longitudinal direction thereof.

11. The device according to claim 8, wherein the trolley is connected to at least one hydraulically driven piston disposed in or on the beam and in the longitudinal direction thereof.

12. The device according to claim 7, wherein the movable support point is comprised of a rotatable wheel or pulley to which the lifting line is movably connected.

13. The device according to claim 1, wherein the beam is provided with two separate hoisting, devices having each a lifting line for vertical movement of said equipment.

14. The device according to claim 1, wherein the top drive is a heave-compensated top drive, and the beam is structured for releasable connection to and between (a) the heave-compensated top drive on a floating vessel and (b) at least one tension member connected to an upper end of a riser connected to a subsea well.

15. A method for transfer of equipment for a wireline operation in a well connected to a drilling derrick via a top drive, wherein the method comprises providing a singular beam having a longitudinal direction with at least one hoisting device with a lifting line for vertical movement of said equipment, wherein the method also comprises:

structuring a support point for the lifting line so as to be movable in the longitudinal direction of the beam, the support point being connected to the beam, whereby said equipment also may be moved horizontally relative to a center line between the top drive and the well;

structuring the beam in a manner allowing the beam to extend transversely relative to said center line;

connecting the beam in a releasable manner to the top drive; and structuring said hoisting device and support point for remote-controlled operation.

* * * * *